US005914537A

United States Patent [19]

Zaviska et al.

[11] Patent Number: 5,914,537

[45] Date of Patent: Jun. 22, 1999

[54] METHOD AND APPARATUS FOR QUICKLY CONTROLLING THE OUTPUT OF A POWER PLANT

[75] Inventors: Oldrich Zaviska, Erlangen; Christian Fricke, Karlsruhe; Herbert Furumoto, Erlangen, all of Germany

[73] Assignee: Siemens Aktiengesellschaft, Munich, Germany

[21] Appl. No.: 09/079,063

[22] Filed: May 14, 1998

Related U.S. Application Data

[63] Continuation of application No. PCT/DE96/02106, Nov. 5, 1996.

[30] Foreign Application Priority Data

Nov. 14, 1995 [DE] Germany ..... 195 42 433

[51] Int. Cl.[6] ..... F01D 19/00

[52] U.S. Cl. ..... 290/52; 290/40 R; 60/652

[58] Field of Search ..... 290/2, 40 R, 52; 60/652, 660, 39.2

[56] References Cited

U.S. PATENT DOCUMENTS

| | | | |
|---|---|---|---|
| 3,801,793 | 4/1974 | Goebel | 290/2 |
| 3,999,787 | 12/1976 | Park | 290/40 R |
| 4,189,925 | 2/1980 | Long | 60/652 |
| 4,246,491 | 1/1981 | Waldron et al. | 290/40 R |
| 4,687,946 | 8/1987 | Jones | 290/40 R |
| 5,063,732 | 11/1991 | Calderon | 60/39.02 |
| 5,433,079 | 7/1995 | Badami et al. | 60/660 |
| 5,715,673 | 2/1998 | Beichel | 60/39.07 |

FOREIGN PATENT DOCUMENTS

| | | |
|---|---|---|
| 3304292C2 | 7/1987 | Germany . |
| 4344118A1 | 6/1995 | Germany . |

OTHER PUBLICATIONS

"Optimal Load Cycling of Large Steam Turbines", Kenneth A.W. Marcelle et al., Jun. 26, 1994, pp. 667–672.

"Beitragsmöglichkeiten der Speisewasser–, Kondensat– und Anzapfdampfströme . . . ", G. Falgenhauer, VGB Kraftwerkstechnik 60, No. 1, Jan. 1980, pp. 18–23.

*Primary Examiner*—Nestor Ramirez
*Assistant Examiner*—Nicholas Ponomarenko
*Attorney, Agent, or Firm*—Herbert L. Lerner; Laurence A. Greenberg

[57] ABSTRACT

A method for quickly controlling the output of a power plant having a turbo-generator set with a steam turbine and a generator, activates energy storage present during a plant process in order to set an additional generator output. In order to achieve a particularly effective control, fuzzy logic is used for the controlled activation of the energy storage. Fuzzy-logic rules from experience at the plant are used in this process. An apparatus for carrying out the method includes a fuzzy-logic system having inputs which include the additional generator output and an energy situation of the activatable storage, and outputs that specify desired setting values for the degree of activation of the individual energy storage.

10 Claims, 2 Drawing Sheets

METHOD AND APPARATUS FOR QUICKLY CONTROLLING THE OUTPUT OF A POWER PLANT

CROSS-REFERENCE TO RELATED APPLICATION

This application is a continuation of International Application No. PCT/DE96/02106, filed Nov. 5, 1996, which designated the United States.

BACKGROUND OF THE INVENTION

FIELD OF THE INVENTION

The invention relates to a method for quickly controlling the output of a power plant having a turbo-generator set with a steam turbine and a generator, wherein energy storage present during a plant process is activated in order to set an additional generator output. The invention also relates to an apparatus for carrying out the method.

Reliable power supply in an electric power supply system presupposes careful tuning between the generation of electric power by a number of power units and the tapping of that energy by a number of consumers in an electricity distribution system. If the generation and tapping of the electric power are equal, the system frequency, which is an essential parameter in an electrical system, is constant. Its nominal value is, for example, 50 Hz in the European interconnected system. A frequency deviation which occurs, for example, due to the failure of a power unit or to the connection or disconnection of a consumer, can be regarded as a measure of an increase or drop in the generator output. A further task in addition to correcting frequency deviations within a power supply system is maintaining a prescribed interchange power at coupling points to subsystems of which the distribution system (interconnected system or separate network) is composed. One requirement therefore is the availability of a quick increase in output of a power unit within seconds.

Possibilities for quickly controlling the output or power and providing frequency back-up control are described in a printed publication entitled "VGB Kraftwerkstechnik" [VGB Power Plant Engineering], No. 1, January 1980, pages 18 to 23.

Although a plurality of intervention possibilities which can be carried out simultaneously or alternatively exist for quickly changing the output within the range of seconds (seconds reserve), a change in the fuel supply is required for a permanent change in the output of a power unit. In a fossil-fuel-fired power station, control valves of the steam turbine which are held in advance in the throttled position are therefore opened within the first seconds for the purpose of bridging delay times, and available steam accumulators are thereby activated and discharged virtually without delay. In addition to an increase in output due to the cancellation of the throttling of control valves of the steam turbine, preheaters which are provided in the water-steam circuit of the steam turbine and are heated through the use of extraction steam from the steam turbine are disconnected. A condenser flow which is simultaneously passed through the low-pressure preheater can be stopped and increased again within a few seconds. That measure for quickly controlling the output in fossil-fuel-fired power units by disconnecting the preheaters with a condensate stop is also described, for example, in German Patent DE 33 04 292 C2.

It is therefore customary to make use of a control device in order to regulate and/or control the quick seconds reserve, that is to say for the purpose of a controlled loading of steam flows to regenerative preheaters and/or heating condensers, as well as of the process steam and the condensate in the water-steam circuit of the steam turbine of a power unit. The control device throttles the supply of steam to preheaters, throttles the process steam and/or throttles the condensate, for the purpose of quickly controlling the output, that is to say of activating the seconds reserve. In that case, desired setting values for control valves at turbine extraction points and for control elements for setting condensate are formed in such a way that a required additional generator output is achieved. However, a disadvantage thereof is that it is extraordinarily difficult to coordinate the required rate of change in output and the output amplitude with other process variables, in particular with temperature changes in preheating trains and/or heating condensers, as well as with discharging the auxiliary condensate. Moreover, the priorities of the use of the individual measures for quickly controlling the output are not taken into account. In addition, because of the usually nonlinear control system, control quality has not been particularly high to date.

SUMMARY OF THE INVENTION

It is accordingly an object of the invention to provide a method and an apparatus for quickly controlling the output of a power plant, which overcome the hereinaforementioned disadvantages of the heretofore-known methods and apparatuses of this general type, which quickly make an output available in a power plant, which achieve a particularly effective control and which use simple measures.

With the foregoing and other objects in view there is provided, in accordance with the invention, a method for quickly controlling the output of a power plant having a turbo-generator set with a steam turbine and a generator, which comprises activating energy storage, accumulators or reservoirs present during a plant process for setting an additional generator output; controlling the activation of the energy storage with fuzzy logic using fuzzy-logic rules from experience at the plant; and determining a degree of activation of individual energy storage with the additional generator output and with an energy situation of the activatable storage.

In this case the invention proceeds from the idea of evaluating a multiplicity of process values or process variables of the plant process. The aim in this case is to analyze in their entirety the process variables which are relevant for the process to be controlled. It is then possible by using fuzzy logic to introduce experience at the plant (expert knowledge) into the evaluation and to take it into account during the subsequent formation of desired setting values.

In accordance with another mode of the invention, the priority of the use of the individual energy storage or reservoirs is taken into account in implementing the fuzzy-logic rules that are required.

In accordance with a further mode of the invention, it is advantageous, in the case of evaluating process variables or process data, in order to determine desired setting values or manipulated variables for the individual energy storage or accumulators, to take information concerning their readiness and/or their temporary restriction into account.

With the objects of the invention in view, there is also provided an apparatus for quickly controlling the output of a power plant having a turbo-generator set with a steam turbine and a generator, wherein energy storage, accumulators or reservoirs present during a plant process are to be activated for setting an additional generator output, comprising a fuzzy-logic system having inputs receiving the additional generator output and an energy situation of the activatable storage and outputs specifying a degree of activation of the individual energy storage.

In accordance with another feature of the invention, the fuzzy-logic system includes a first fuzzy-logic controller having inputs which include the energy situation of the activatable storage, and an output that specifies a strategy of use for measures to be carried out as well as temporary restrictions of the individual activatable storage. The first fuzzy-logic controller preferably additionally has an input for the degree of throttling of at least one control element connected to the steam turbine on the inlet side.

In accordance with a further feature of the invention, the fuzzy-logic system includes a second fuzzy-logic controller having inputs which include the desired output value and an actual additional output value of the generator as well as the strategy of use and the restrictions, and outputs that specify desired setting values for steam control elements.

In accordance with an added feature of the invention, the fuzzy-logic system includes a third fuzzy-logic controller having inputs which include the actual setting value of at least one steam control element and the actual temperature value and/or actual pressure value of feedwater stored in the water-steam circuit, and outputs that specify desired setting values for condensate control elements. In this case, one input of the third fuzzy-logic controller preferably includes a value for the damper response of at least one steam control element.

In accordance with a concomitant feature of the invention, the fuzzy-logic system includes a fourth fuzzy-logic controller having an input which includes an actual value for a level in at least one intermediate accumulator or reservoir connected in the water/steam circuit, and an output that specifies a desired setting value for entering condensate into, or extracting it from, a condensate accumulator or reservoir.

The advantages achieved through the use of the invention are, in particular, that the use of fuzzy logic in conjunction with experience at the plant results in controlled activation of the energy storage present during the plant process. In this case, the priorities of the use of individual measures can be taken into account. Moreover, a gentle running procedure is ensured at the same time as a particularly effective use of available energy storage. In particular, quick, high-quality control of the output or power is achieved.

Other features which are considered as characteristic for the invention are set forth in the appended claims.

Although the invention is illustrated and described herein as embodied in a method and an apparatus for quickly controlling the output of a power plant, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
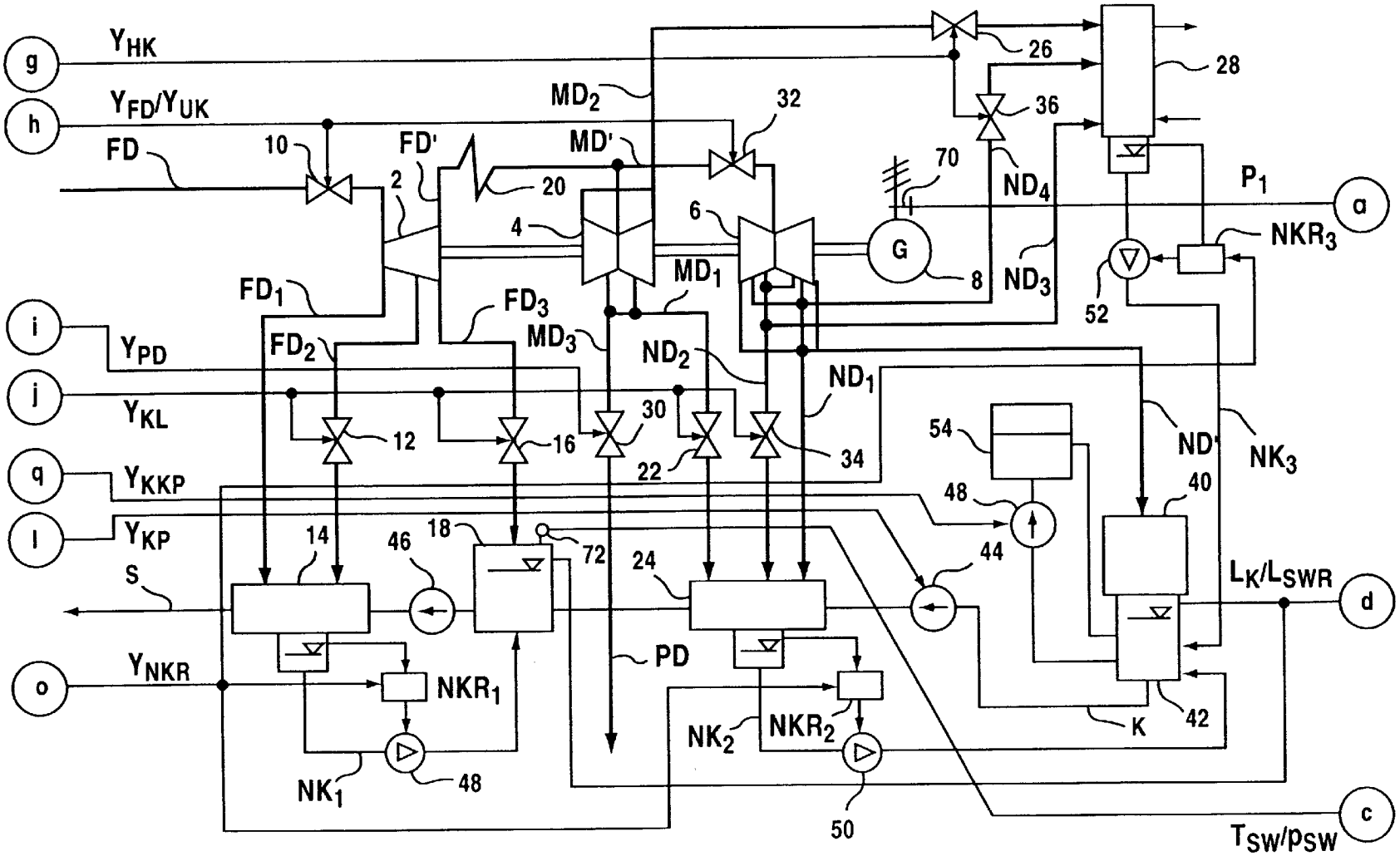
FIG. 1 is a schematic and block diagram of a turbo-generator as a process section of a power unit.

Referring now to the figures of the drawings in detail and first, particularly, to FIG. 1 thereof, there is seen a basic block diagram of a process section of a power station unit having a turbo-generator set, which includes a high-pressure turbine section 2, an intermediate-pressure turbine section 4 and a low pressure turbine section 6, as well as a generator 8. During operation of the turbo-generator set, main steam FD is introduced into the high-pressure turbine section 2 through a main-steam control valve 10. A first partial flow $FD_1$ and a second partial flow $FD_2$ which can be set through the use of a control valve 12, are extracted from the high-pressure turbine section 2 for a high-pressure preheating train 14. A third partial flow $FD_3$, which can be set through the use of a further control valve 16, is extracted from the high-pressure turbine section 2 for a feedwater tank or accumulator 18. Exhaust steam FD' from the high-pressure turbine section 2 is fed through a reheater 20 to the intermediate-pressure turbine section 4.

A further extraction of steam is performed from the intermediate-pressure turbine section 4. For this purpose, a control valve 22 is used to extract a settable first partial flow $MD_1$ for a low-pressure preheating train 24. A further extraction is performed through a second partial flow $MD_2$, which can be set through the use of a control valve 26, for a heating condenser 28. Furthermore, an extraction is performed as process steam PD through a third partial flow $MD_3$ which can be set through the use of a control valve 30. Exhaust steam MD' of the intermediate-pressure turbine section 4 is fed through a pressure-relief damper 32 to the low-pressure turbine section 6.

Steam is likewise extracted from the low-pressure turbine section 6 for the low-pressure preheating train 24 and for the heating condenser 28. For this purpose, a first partial flow $ND_1$ is fed directly and a second partial flow $ND_2$ is fed through a control valve 34, to the low-pressure preheating train 24. Likewise, a third partial flow $ND_3$ is fed directly and a fourth partial flow $ND_4$ is fed through a control valve 36, to the heating condenser 28. Exhaust steam ND' from the low-pressure turbine section 6 condenses in a condenser 40.

Main condensate K is conveyed from a hotwell or accumulator 42 of the condenser through the low-pressure preheating train 24 into the feedwater tank or storage 18, through the use of a condensate pump 44. Feedwater S is conveyed from the feedwater tank 18 through the high-pressure preheating train 14 through the use of a feedwater pump 46. An auxiliary condensate or a drain $NK_1$ from the high-pressure preheating train 14 is conveyed into the feedwater tank 18 through an auxiliary condensate pump 48. An auxiliary condensate $NK_2$ or a drain is likewise conveyed from the low-pressure preheating train 24 through an auxiliary condensate pump 50 into the condenser 40, that is to say into the hotwell 42 thereof. In addition, an auxiliary condensate or drain $NK_3$ is conveyed from the heating condenser 28 into the hotwell or storage 42 of the condenser 40, through the use of an auxiliary condensate pump 52.

Whereas the main condensate K and the feedwater S are conveyed through a level control $L_K/L_{SWB}$, the conveyance of the auxiliary condensates $NK_{1,2,3}$ is set through separate level controls $NKR_1$, $NKR_2$ and $NKR_3$. The latter can receive a common desired setting value $Y_{NKR}$. A cold condensate accumulator or storage 54 which is connected through a condensate pump 48 to the hotwell 42 of the condenser 40, in this case serves the purpose of entering or extracting a portion of the main condensate K.

Figure 2:
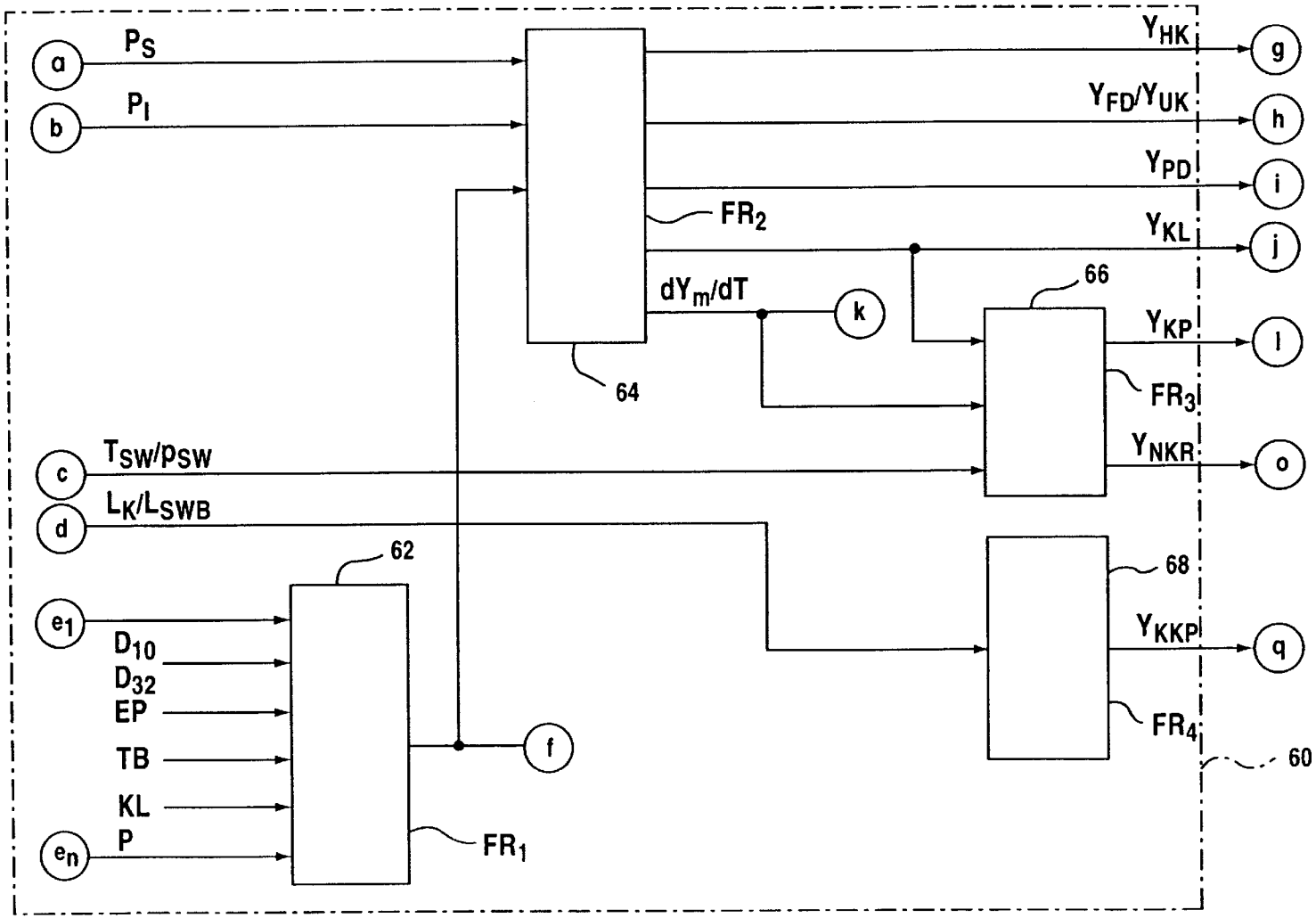
FIG. 2 is a block diagram of a fuzzy-logic system as a control apparatus of a process section according to FIG. 1.

A device for quickly controlling output is represented in FIG. 2. The device includes a fuzzy-logic system 60 having first, second, third and fourth fuzzy-logic controllers 62, 64, 66 and 68. The fuzzy-logic system 60 receives a frequency-corrected desired output value $P_s$ and an actual additional output value $P_I$ of the generator 8 as input variables. The actual additional output value $P_I$ is measured through the use of a measuring device 70 on the generator 8, which is shown in FIG. 1. Further input variables of the fuzzy-logic system 60 are temperature $T_{sw}$ and pressure $P_{sw}$ of the feedwater S, which are measured through the use of a measuring device 72 in the feedwater tank 18, as is shown in FIG. 1. Furthermore, a condensate level $L_K$ measured in the hotwell 42 of the condenser 40 and a feedwater level $L_{SWB}$ measured in the feedwater tank 18, are fed to the fuzzy-logic system 60 as input variables. Information concerning degrees of throttling $D_{10}$, $D_{32}$ of the main steam control valve 10 and of the pressure relief damper 32 and data regarding priorities of use EP, technical readiness TB and load capability KL of the power station, as well as further process variables P, are fed to the fuzzy-logic system 60 as further input variables $e_1$ . . . en.

The inputs $e_1$ . . . $e_n$ belong to the first fuzzy-logic controller 62 of the fuzzy-logic system 60. They take account of the process variables $D_{10}$, $D_{32}$, EP, TB, KL and P which are relevant for the process section to be controlled. A strategy of use is defined for measures required for quickly controlling the output of the power unit. This is done with the aid of fuzzy-logic rules $FR_1$ from experience at the plant (expert knowledge) which are stored in the first fuzzy-logic controller 62. Furthermore, temporary restrictions on energy storage or stores to be activated in the process section are determined there. This strategy of use, that is to say the staggering of measures and restrictions, form an output variable f of the first fuzzy-logic controller 62.

This output variable f is simultaneously an input variable of the second fuzzy-logic controller 64. Further input variables a and b of the second fuzzy-logic controller 64 are the frequency-corrected desired output value $P_s$ and the actual additional output value $P_I$. Output variables g to k are determined in the second fuzzy-logic controller 64 from these input variables a, b and f with the aid of fuzzy-logic rules $FR_2$. While the output variables g to j are desired setting values, the output variable k is an estimated damper response $dY_m/dt$ of the control element or of each control element 10, 12, 16, 22, 26, 32, 34 and 36 provided in the process section in according to FIG. 1. The output variable g of the second fuzzy-logic controller 64 specifies desired setting values $Y_{HK}$ for the hot-condensate control valves 26 and 36. The output variable h specifies desired setting values $Y_{FD}$, $Y_{OK}$ for the main steam control valve 10 and the pressure relief damper 32. The output variable i specifies a desired setting value $Y_{PD}$ for the control valve 30 which sets the quantity of process steam PD to be coupled out per unit time. The output variable j specifies desired setting values $Y_{KL}$ for the extraction-steam control valves 12, 16, 22 and 34.

The output variables j and k of the second fuzzy-logic controller 64 are simultaneously input variables of the third fuzzy-logic controller 66. The third fuzzy-logic controller 66 receives the temperature $T_{sw}$ and the pressure $P_{sw}$ of the feedwater S in the feedwater tank 18 as further input variables c. Desired setting values $Y_{KP}$, $Y_{NKR}$ for the condensate controller or auxiliary condensate controller $NKR_{1,2,3}$ are formed from these input variables j, k and c with the aid of fuzzy-logic rules $FR_3$, as output variables 1 and o.

In the fourth fuzzy-logic controller 68 of the fuzzy-logic system 60, a desired setting value $Y_{KKP}$ is formed as an output variable q for the quantity of condensate K to be entered into or extracted from the cold-condensate accumulator 54.

For this purpose, the condensate level and the feedwater level $L_K$ and $L_{SWB}$ are respectively fed to the fuzzy-logic controller 68 as an input variable d. The desired setting value $Y_{KKP}$ is likewise formed with the aid of fuzzy-logic rules $FR_4$.

The knowledge of process engineering used in the fuzzy-logic system 60 ensures both a gentle running procedure of the power plant or the power unit in the case of quick changes in output, and a particularly effective utilization of the available energy storage. The knowledge of process engineering is incorporated in this case into the fuzzy-logic rules $FR_1$ to $FR_4$, of the individual fuzzy-logic controllers 62 to 68. In particular, the priority of the use of the individual energy storage or accumulators is taken into account in order to implement the fuzzy-logic rules $FR_1$ of the first fuzzy-logic controller 62. The energy storage or accumulators are activated by throttling the steam supply to the preheating trains 14 and 24 and/or by throttling the process steam PD, as well as by throttling the condensate K and/or the auxiliary condensate $NK_{1,2,3}$. The formation of appropriate desired setting values Y for the control valves or regulating valves at the turbine extraction points and for condensate regulation is performed in this case with regard to the setting of a required additional generator output $P_s$.

We claim:

1. A method for quickly controlling the output of a power plant having a turbo-generator set with a steam turbine and a generator, which comprises:

activating energy storage present during a plant process for setting an additional generator output;

controlling the activation of the energy storage with fuzzy logic using fuzzy-logic rules from experience at the plant; and determining a degree of activation of individual energy storage with the additional generator output and with an energy situation of the activatable storage.

2. The method according to claim 1, which comprises taking a priority of use of the individual energy storage into account in implementing the fuzzy-logic rules.

3. The method according to claim 1, which comprises determining desired setting values for the individual energy storage by taking information concerning their readiness into account.

4. An apparatus for quickly controlling the output of a power plant having a turbo-generator set with a steam turbine and a generator, comprising:

energy storage present during a plant process to be activated for setting an additional generator output; and a fuzzy-logic system having inputs receiving said additional generator output and an energy situation of said activatable storage and outputs specifying a degree of activation of said individual energy storage.

5. The apparatus according to claim 4, wherein said fuzzy-logic system includes a fuzzy-logic controller having inputs receiving the energy situation of said activatable storage and an output specifying a strategy of use for measures to be carried out as well as for temporary restrictions of said activatable storage.

6. The apparatus according to claim 5, wherein said fuzzy-logic controller has an input for receiving a degree of throttling of at least one control element connected to an inlet side of the steam turbine.

7. The apparatus according to claim 4, wherein said fuzzy-logic system includes a fuzzy-logic controller having inputs receiving the desired output value and an actual additional output value of the generator as well as a strategy of use and restrictions, and outputs specifying desired setting values for control elements.

8. The apparatus according to claim 4, wherein said fuzzy-logic system includes a fuzzy-logic controller having inputs receiving a desired setting value of at least one extraction steam control element and at least one of an actual temperature value and an actual pressure value of stored feedwater, and outputs specifying desired setting values for condensate control elements.

9. The apparatus according to claim 8, wherein one of said inputs of said fuzzy-logic controller receives a value for a damper response of at least one control element.

10. The apparatus according to claim 4, wherein said fuzzy-logic system includes a fuzzy-logic controller having an input receiving a value for a level in at least one intermediate accumulator and an output specifying a desired setting value for entering condensate into or extracting condensate from a condensate accumulator.

* * * * *